US011038268B2

(12) United States Patent
Ghelfi et al.

(10) Patent No.: US 11,038,268 B2
(45) **Date of Patent: *Jun. 15, 2021**

(54) SIGNAL GENERATOR FOR A PHASED ARRAY ANTENNA

(71) Applicant: Telefonaktiebolaget LM Ericsson (publ), Stockholm (SE)

(72) Inventors: Paolo Ghelfi, Pisa (IT); Antonella Bogoni, Pisa (IT); Francesco Laghezza, Pisa (IT); Sergio Pinna, Pisa (IT); Filippo Scotti, Pisa (IT); Giovanni Serafino, Pisa (IT)

(73) Assignee: TELEFONAKTIEBOLAGET LM ERICSSON (publ), Stockholm (SE)

( * ) Notice: Subject to any disclaimer, the term of this patent is extended or adjusted under 35 U.S.C. 154(b) by 419 days.

This patent is subject to a terminal disclaimer.

(21) Appl. No.: 14/914,251

(22) PCT Filed: Aug. 30, 2013

(86) PCT No.: PCT/EP2013/068029
§ 371 (c)(1),
(2) Date: Feb. 24, 2016

(87) PCT Pub. No.: WO2015/028091
PCT Pub. Date: Mar. 5, 2015

(65) Prior Publication Data

US 2016/0211578 A1 Jul. 21, 2016

(51) Int. Cl.
*H01Q 3/26* (2006.01)

(52) U.S. Cl.
CPC ..... *H01Q 3/2676* (2013.01)

(58) Field of Classification Search
CPC ..... H01Q 3/2676
See application file for complete search history.

(56) References Cited

U.S. PATENT DOCUMENTS 5,374,935 A 12/1994 Forrest
5,526,170 A * 6/1996 Esman ..... G02B 6/2861 356/318

(Continued)

FOREIGN PATENT DOCUMENTS

JP 2007067802 A * 3/2007
WO WO-2011106831 A1 * 9/2011 ..... H01Q 3/2676
WO 2013117216 A1 8/2013

OTHER PUBLICATIONS

Paolo Ghelfi et al, "Photonic generation of RF multiple carriers using a mode-locked laser and a single photodiode," Proc. SPIE 7960, Coherent Optical Communication: Components, Subsystems, and Systems, 79600Q (Jan. 25, 2011). pp. 1-8. (Year: 2011).*

(Continued)

*Primary Examiner* — Gregory C. Issing
(74) *Attorney, Agent, or Firm* — Leffler Intellectual Property Law, PLLC

(57) ABSTRACT

A signal generator for a phased array antenna comprises a laser light source arranged to provide an optical spectrum comprising a plurality of spaced wavelengths. The signal generator further comprises a dispersion unit arranged to introduce a delay to a plurality of spectral components of the optical spectrum associated with the spaced wavelengths. The delay is dependent on the wavelength of the spectral components of the optical spectrum. The signal generator further comprises a heterodyning device configured to generate a signal for the phased array antenna by heterodyning the spectral components associated with different ones of the spaced wavelengths of the laser light source.

17 Claims, 4 Drawing Sheets

(56) References Cited

U.S. PATENT DOCUMENTS

| | | | | | |
|---|---|---|---|---|---|
| 5,677,697 | A * | 10/1997 | Lee | G01S 7/282 | 342/368 |
| 6,016,371 | A * | 1/2000 | Wickham | G02B 6/2861 | 385/10 |
| 6,661,377 | B2 * | 12/2003 | Lee | H01Q 3/2676 | 342/375 |
| 6,724,523 | B2 * | 4/2004 | Yap | H01Q 3/2676 | 330/3 |
| 6,731,829 | B2 * | 5/2004 | Ionov | H04B 10/11 | 385/15 |
| 7,974,534 | B2 * | 7/2011 | Weiner | H04B 1/40 | 398/85 |
| 2007/0229937 | A1 * | 10/2007 | Josef Moeller | G02F 1/3534 | 359/326 |
| 2008/0063411 | A1 * | 3/2008 | Lekkas | H04B 10/25758 | 398/187 |
| 2009/0092158 | A1 * | 4/2009 | Izadpanah | G01S 7/282 | 372/18 |
| 2013/0010819 | A1 * | 1/2013 | Ahmad | H01S 1/02 | 372/6 |
| 2014/0010547 | A1 * | 1/2014 | Dong | H04B 1/18 | 398/116 |
| 2014/0161464 | A1 * | 6/2014 | Bowers | H04B 10/90 | 398/115 |
| 2017/0244165 | A1 * | 8/2017 | Ghelfi | H01Q 3/2676 | |

OTHER PUBLICATIONS

Ghelfi et al. "Photonic Generation of Phase-Modulated RF Signals for Pulse Compression Techniques in Coherent Radars." Journal of Lightwave Technology, vol. 30, No. 11. Jun. 1, 2012. pp. 1638-1644. (Year: 2012).*

Li et al. "Photonic phased-array antenna system based on detector-switched optical Blass matrix true-time-delay steering and heterodyne rf generation," Proc. SPIE 4087, Applications of Photonic Technology 4, Dec. 15, 2000. 5 Pages. (Year: 2000).*

Yilmaz et al. "Toward a Photonic Arbitrary Waveform Generator Using a Modelocked External Cavity Semiconductor Laser." IEEE Photonics Technology Letters, vol. 14, No. 11. Nov. 2002. pp. 1608-1610. (Year: 2002).*

Chi et al. "An Approach to Photonic Generation of High-Frequency Phase-Coded RF Pulses." IEEE Photonics Technology Letters, vol. 19, No. 10, May 15, 2007. pp. 768-770. (Year: 2007).*

Tong et al. "A Novel Multiwavelength Optically Controlled Phased Array Antenna with a Programmable Dispersion Matrix." IEEE Photonics Technology Letters, vol. 8, No. 6. Jun. 1996. pp. 812-814. (Year: 1996).*

Rideout et al. "A True Time Delay Beamforming System Incorporating a Wavelength Tunable Optical Phase Lock Loop." Journal of Lightwave Technology, vol. 25, No. 7, Jul. 2007. pp. 1761-1770. (Year: 2007).*

Li et al. "Optically generated dynamically tunable, low noise millimeter wave signals using microchip solid state lasers." 2003 IEEE MTT-S Digest. (Year: 2003).*

H. R. Rideout, J. S. Seregelyi and J. Yao, "A True Time Delay Beamforming System Incorporating a Wavelength Tunable Optical Phase-Lock Loop," in Journal of Lightwave Technology, vol. 25, No. 7, pp. 1761-1770, Jul. 2007. doi: 10.1109/JLT.2007.899189 (Year: 2007).*

Michael G. Wickham, Lawrence A. Dozal, Lawrence J. Lembo, John C. Brock, "Fiber optic Bragg grating true-time-delay generator for broadband rf applications," Proc. SPIE 2560, Optical Technology for Microwave Applications VII, (Oct. 1, 1995). (Year: 1995).*

A. Molony, et al, "Fiber Bragg-grating true time-delay systems: discrete-grating array 3-b delay lines and chirped-grating 6-b delay lines," in IEEE Transactions on Microwave Theory and Techniques, vol. 45, No. 8, pp. 1527-1530, Aug. 1997. doi: 10.1109/22.61 (Year: 1997).*

G. A. Ball, et al, "Programmable fiber optic delay line," in IEEE Photonics Technology Letters, vol. 6, No. 6, pp. 741-743, Jun. 1994. doi: 10.1109/68.300180. (Year: 1994).*

I. Frigyes and A. J. Seeds, "Optically generated true-time delay in phased-array antennas," in IEEE Transactions on Microwave Theory and Techniques, vol. 43, No. 9, pp. 2378-2386, Sep. 1995. (Year: 1995).*

A. Capozzoli, C. Curcio, and G. D'Elia, "The Design of an Optical Time Steered Antenna Based on a New Integrated True Time Delay Unit," Progress in Electromagnetics Research, vol. 140, 681-717, 2013. doi:10.2528/PIER12081512 (Year: 2013).*

Yasaka, Hiroshi et al. "Multiwavelength Light Source with Precise Frequency Spacing Using Mode-Locked Semiconductor Laser and Arrayed Waveguide Grating Filter." OFC '96 Technical Digest. p. 299-300. (Year: 1996).*

Chang, Yin et al. "Optically Controlled Serially Fed Phased Array Transmitter." IEEE Microwave and Guideed Wave Letters, vol. 7, No. 3. Mar. 1997. pp. 69-71. (Year: 1997).*

Yao, Jianping. "Microwave Photonics." Journal of Lightwave Technology, vol. 27, No. 3. Feb. 2009. pp. 314-335. (Year: 2009).*

Nagatsuma, Tado et al. "Photonic Generation of Millimeter and Tetraherz Waves and Its Applications." 19th International Conference on Applied Electromagnetics and Communications. Sep. 2007. pp. 1-4. (Year: 2007).*

Madjar et al. "Microwave Generation by Optical Techniques—A Review" 36th European Conference: Microwave Conference 2006. Oct. 2006 (Year: 2006).*

Ghelfi et al. "Generation of Highly Stable Microwave Signals Based on Regenerative Fiber Mode Locking Laser." CLEO/QELS: 2010 Laser Science to Photonic Applications, San Jose, CA, 2010, pp. 1-2, doi: 10.1364/CLEO.2010.JWA47. (Year: 2010).*

Laghezza, F., et al (2011). Reconfigurable radar transmitter based on photonic microwave signal generation. International Journal of Microwave and Wireless Technologies, 3(3), 383-389. doi:10.1017/S1759078711000262 (Year: 2011).*

Translation of Description of JP2007067802 (Year: 2007).*

PCT International Search Report, dated Jun. 17, 2014, in connection with International Application No. PCT/EP20131068029, all pages.

C. Roeloffzen et al., Development of a Broadband Integrated Optical Beamformer for Ku-Band Phased Array Antennas, 8 pages.

C. Roeloffzen et al., Development of an Integrated Photonic Beamformer for Electronically-Steered Ku-Band Phased Array Antenna, SATRAX, Smart Antenna Satcom Systems, ESA Antenna workshop, May 10, 2012, 25 pages.

M. Chtioui et al., High Responsivity and High Power UTC and MUTC GaInAs—InP Photodiodes, IEEE Photonics Technology Letters, vol. 24, No. 4, Feb. 15, 2012, pp. 318-320.

P. Ghelfi et al., Photonic generation of RF multiple carriers using a mode-locked laser and a single photodiode, 7 pages, SPIE OPTO 2011, San Francisco, California.

P. Ghelfi et al., Phase Coding of RF Pulses in Photonics-Aided Frequency-Agile Coherent Radar Systems, IEEE Journal of Quantum Electronics, vol. 48, No. 9, Sep. 2012, pp. 1151-1157.

A. P. Goutzoulis et al., Hybrid electronic fiber optic wavelength-multiplexed system for true time-delay steering of phased array antennas, Optical Engineering, Nov. 1992, vol. 31, No. 11, pp. 2312-2322.

C.K. Madsen et al., Integrated All-Pass Filters for Tunable Dispersion and Dispersion Slope Compensation, IEEE Photonics Technology Letters, vol. 11 No. 12, Dec. 1999, pp. 1623-1625.

K. Prince et al., Variable Delay With Directly-Modulated R-SOA and Optical Filters for Adaptive Antenna Radio-Riber Access, Journal of Lightwave Technoloty, vol. 27, No. 22, Nov. 15, 2009, pp. 5056-5064.

R. Soref, Optical dispersion technique for time-delay beam steering, 1992 Optical Society of America, Dec. 10, 1992, vol. 31, No. 35, Applied Optics, pp. 7395-7397.

Q. Xu et al., Micrometre-scale silicon electro-optic modulator, Nature, vol. 435, May 19, 2005, pp. 325-327.

L. Yaron et al., Photonic Beamformer Receiver With Multiple Beam Capabilities, IEEE Photonics Technology Letters, vol. 22, No. 23, Dec. 1, 2010, pp. 1723-1725.

(56) References Cited

OTHER PUBLICATIONS

A. Zadok et al., Optically Controlled Low-Distortion Delay of GHz-Wide Radio-Frequency Signals Using Slow Light in Fibers, IEEE Photonics Technology Letters, vol. 19, No. 7, Apr. 1, 2007, pp. 462-464.
W. Bogaerts et al., Silicon microring resonators, Laser Photonics Rev. 6, No. 1, 2012, pp. 47-73.
R. Romanofsky, Array Phase Shifters: Theory and Technology, NASA/TM-2007-214906, Oct. 2007, 32 pages.
M.R. Surette et al., An Optically Driven Phased Array Antenna Utilizing Heterodyne Techniques, Journal of lightwave Technology, vol. 11. No. 9, Sep. 1993, pp. 1500-1509.
European Communication dated Jul. 1, 2020 in connection with European Application No. 13753664.5, 5 pages.
Paolo Ghelfi et al., "Photonic Generation of Phase-Modulated RF Signals for Pulse Compression Techniques in Coherent Radars", Journal of Lightwave Technology, vol. 30, No. 11, Jun. 1, 2012, pp. 1638-1644.

* cited by examiner

SIGNAL GENERATOR FOR A PHASED ARRAY ANTENNA

TECHNICAL FIELD

Aspects of the invention relate to a signal generator for a phased array antenna, a method of generating a signal for a phased array antenna, and a phased array.

BACKGROUND

Phased array antennas (PAAs) allow steering of transmitted Radio Frequency (RF) beam without physically moving the antenna. Phased array antennas are used in an increasing number of applications such as multifunctional radars, electronic warfare, and communications.

It is known for PAAs to use electronic phase shifters at each antenna element to control the viewing angle of the array. For broadband signals, this approach suffers from the squint phenomenon, which causes different frequencies of the RF signal spectrum to aim at a different angle. As is also known, squint can be avoided if the phase shifters are substituted by true-time delays (TTDs).

A photonics approach has been proposed for realizing the TTD functionality in PAAs, utilizing the photonics capability of controllable delays with wide bandwidth, avoiding beam squint. Photonics also have with the advantages of low weight and Electro-Magnetic Interference (EMI) insensitivity.

An optical tunable TTD has been demonstrated through optical path switching, as described in A. P. Goutzoulis, et al., Opt. Eng., v. 31, pp. 2312-2322, 1992. An optical tunable TTD with dispersive elements is described in K. Prince, et al., IEEE J. Lightwave Technol., v. 27, n. 22 (2009). Such photonics-based solutions require a generation of an RF signal, to which the TTD delay is subsequently added.

SUMMARY

A first aspect of the present invention provides a signal generator for a phased array antenna. The signal generator comprises a laser light source arranged to provide an optical spectrum comprising a plurality of spaced wavelengths, and a dispersion unit arranged to introduce a delay to a plurality of spectral components of the optical spectrum associated with the spaced wavelengths. The delay is dependent on the wavelength of the spectral components of the optical spectrum. The signal generator further comprises a heterodyning device configured to generate a signal for the phased array antenna by heterodyning the spectral components associated with different ones of the spaced wavelengths of the laser light source.

Thus, an RF signal is generated directly from an optical signal, without requiring a separate RF signal to be generated. The optical signal generating the RF signal is used to introduce a true time delay for beamforming.

A second aspect of the present invention provides a method of generating a signal for a phased array antenna. The method comprises providing an optical spectrum comprising a plurality of spaced wavelengths, and introducing a delay to spectral components of the optical spectrum associated with the spaced wavelengths. The delay is dependent on the wavelength of the spectral components of the optical spectrum. The method further comprises heterodyning the spectral components associated with different ones of the spaced wavelengths of the laser light source to generate a signal for the phased array.

A third aspect of the present invention provides a phased array comprising a plurality of phased array antenna elements. The phased array further comprises a laser light source arranged to provide an optical spectrum comprising a plurality of spaced wavelengths, and a dispersion unit arranged to introduce a delay to a plurality of spectral components of the optical spectrum associated with the spaced wavelengths. The delay is dependent on the wavelength of the spectral components of the optical spectrum. The signal generator further comprises a heterodyning device configured to generate a signal for the phased array antenna by heterodyning the spectral components associated with different ones of the spaced wavelengths of the laser light source.

A fourth aspect of the present invention provides a computer program product, configured when run on a computer to carry out a method as described.

BRIEF DESCRIPTION OF THE DRAWINGS

Embodiments of the present invention will now be described, by way of example only, with reference to the accompanying drawings in which.

DETAILED DESCRIPTION

Aspects of the present invention relate to generating and managing RF signals to be transmitted by a phased array antenna. In some aspects, the signals are multiple independent RF signals.

Examples of the invention use photonics both for generating at least one wideband RF signal, and for independently managing the time delay to each element of an antenna array. This provides for a flexible wideband multiple-signal beamforming.

Figure 1:
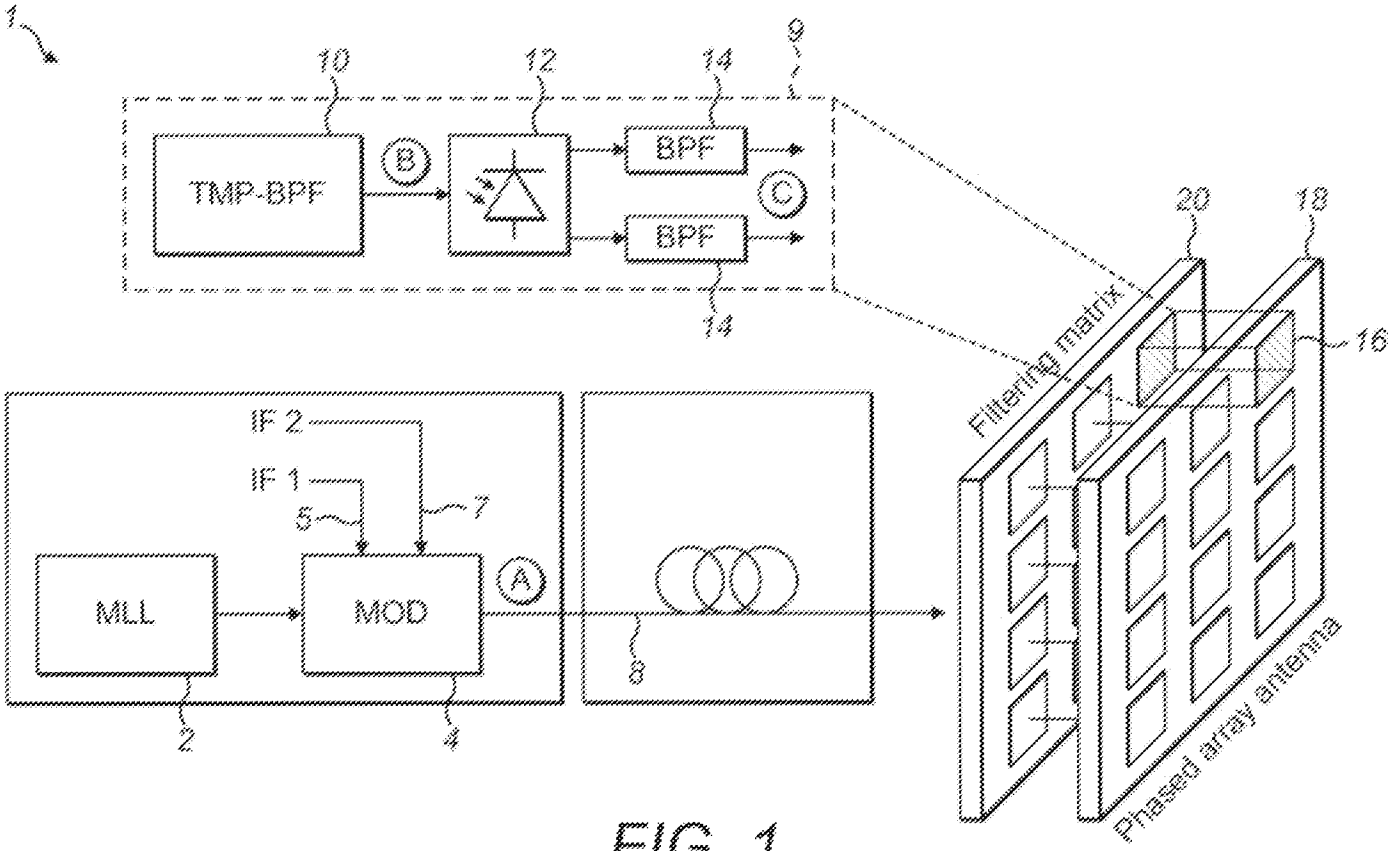
FIG. 1 is schematic illustration of the signal generator and phased array antenna according to an example of the invention.

FIG. 1 shows a schematic functional diagram of a signal generator 1 for a phased array antenna according an example of the invention. The signal generator 1 is configured to generate signals for a phase array antenna, e.g. to be transmitted by the phase array antenna.

The signal generator 1 comprises a laser light source, for example, in the form of a mode-locked laser (MLL) 2. The mode-locked laser 2 is configured to generate a plurality of discrete wavelengths, corresponding to longitudinal modes of the laser. The modes are separated by a repetition wavelength or frequency. For example, the laser source is a fiber laser, e.g. a fiber mode-locked laser. In some aspects, the laser source of the signal generator is only the single mode-locked laser, avoiding a need for multiple lasers or a tunable laser.

At least one of the wavelengths of the mode-locked laser 2 is modulated with a modulator 4. The modulator 4 is an electro-optic modulator. Any type of modulator may be used, e.g. a ring resonator or Mach-Zehnder modulator.

The modulator 4 applies a modulation to the optical signal at one or more frequencies. The one or more frequencies are at an Intermediate Frequency (IF), rather than an RF modulation. In the example shown, a plurality of modulations are applied to provide for a corresponding plurality of modulated RF signals. The plurality of modulations are applied using a different frequency IF signal for each modulation. The IF signals applied contain a modulation. For example, to one or more of the spaced wavelengths from the laser light source is applied a first IF, IF1 5, at a frequency $f_{IF1}$. In this example, a second IF, IF2 7, is applied at a frequency $f_{IF2}$. One or more modulations may be applied, e.g. using one or more IF signals, and is not limited to two IF signals. In some aspects, the modulation is a baseband signal, i.e. not at an Intermediate Frequency.

Figure 2A:
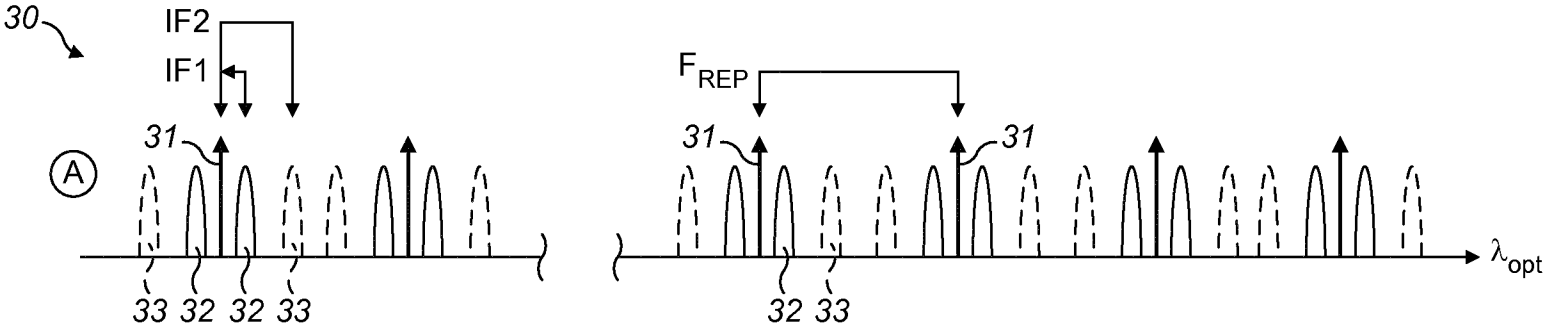
FIGS. 2*a*, 2*b* and 2*c* are examples of spectrum handled by the signal generator.

FIG. 2*a* shows an exemplary spectrum 30 of the optical signal, at a point A at an output of the modulator 4. The spectrum 30 includes the plurality of wavelengths 31 of the laser source, e.g. corresponding to the laser modes. The modes 31 are examples of spaced wavelengths, e.g. separated by the repetition frequency ($f_{REP}$). The optical signal also includes the mode wavelengths modulated by the one or more IF signal. In some examples, the modulation results in further wavelengths at $f_{REP}\pm f_{IF1}$ 32 and $f_{REP}\pm f_{IF2}$ 33. The optical signal comprises repeating mode wavelengths 31, and further associated modulation wavelengths 32,33. In one example, the modulation is with 1 ns-long pulses (1 GHz modulation bandwidth). Any type of modulation may be applied, for example, on-off keying or phase modulation.

Referring to FIG. 1, after modulation, the optical signal is passed into a dispersion unit 8 configured to introduce a time delay to the optical signal. The dispersion unit 8 is a dispersive element, and may be termed an optical dispersion unit 8 or optical delay unit. The time delay introduced is dependent on the wavelength of the optical signal.

In an example, the dispersion unit is a dispersion compensating fiber (DCF). The dispersion compensating fiber 8 introduces a delay to the optical signal by an amount of time dependent on the wavelength of each optical signal. The fiber is configured to introduce chromatic dispersion. In particular, the fiber used to bring the signal to the antenna induces chromatic dispersion on all the wavelengths of the optical signal. In some examples, the DCF has a length which provides for the laser source 2 and/or modulator 4 to be remote from a phase array antenna (described below). In some examples, the dispersion unit 8 is common for all elements of the PAA.

The dispersion unit 8 (i.e. DCF) is common for all the optical wavelengths. Thus, the same dispersion unit 8 is used for generating all the RF signals. In some aspects, the dispersion unit 8 is a single fiber arranged to introduce a time delay to the optical signal which is dependent on the wavelength. The chromatic dispersion is applied after the MLL output is modulated. In some examples, the dispersion unit 8 (e.g. fiber) is common for all elements of the PAA.

In some examples, the dispersion unit 8 (i.e. dispersive element) can be integrated with the modulator 2. For example, the modulator 2 is a ring resonator coupled to a single waveguide.

The dispersion unit 8 receives spectral components, being the plurality of laser modes and any associated wavelengths resulting from modulation. The term 'spectral component' will be used to refer to any component of the optical spectrum which is carried by the dispersion unit, and subsequently processed as described below. The plurality of laser modes and any associated wavelengths resulting from modulation may be considered as based on the wavelengths from the laser source. Thus, any spectral component is based on the laser source wavelengths, since the spectral components are derived directly or from an applied IF signal and/or modulation from the laser source. The spectral component of the laser mode itself may also be considered as associated with that laser mode. For example, spectral components 31,32,33 of the optical spectrum are associated with a particular one of the spaced wavelengths (e.g. one of the laser modes). A spectral component which is modulated but does not have a separate modulation sideband may also be considered as associated with that laser mode. In any example, the original unmodulated spaced wavelength may or may not be present with the modulated spectral components.

For example, the spectral component is a wavelength generated by the laser light source, e.g. generated directly by the laser light source. The spectral component is the wavelength of the mode generated by the mode-locked laser. In some examples, the wavelength is not modified after generation by the laser light source, e.g. not modified by modulation. In some examples, the frequency of the spectral component is not substantially modified after generation, e.g. because it is not modulated or modulated by a baseband signal as described below.

The DCF transports the optical signal to a first filter 10. The first filter 10 is configured to select a plurality of laser modes, including the associated wavelengths resulting from modulation of the laser modes. The first filter 10 is associated with a particular one or more elements of the PAA. The signal generator comprises a plurality of first filters 10.

In some examples, the first filter 10 selects spectral components associated with at least two spaced wavelengths, e.g. at least two modes. The selected spectral components may comprise the wavelengths resulting from modulation of the laser modes. In some examples, the first filter 10 selects more than two such laser modes. The selection of more than two laser modes, including the associated wavelengths resulting from modulation of the laser modes, provides for generating a plurality of RF signals of different frequency. The first filter 10 selects the desired pairs of modes from the MLL spectrum.

In some aspects, the first filter 10 is a tunable filter. The tunable first filter 10 is configured to select a variable pass band of the optical signal. The tunable first filter 10 is configured to vary a lower limit of the passband and/or a higher limit of the passband. Thus, the first filter 10 is configured to determine from which part of the optical spectrum the spectral components are passed. The first filter 10 comprises one or more passbands. Each passband comprises one or more spectral components. The selected spectral components are associated with adjacent or non-adjacent spaced wavelengths (e.g. adjacent or non-adjacent modes).

The first filter 10 is controlled to select spectral components according to the frequency of the RF signal selected and the delay which is required. For example, the spectral component are selected according to the spaced wavelengths (modes) with which the spectral components are associated. The selection of the spaced wavelengths (e.g. modes) substantially determines the frequency of the RF signal and the time delay from the dispersion unit. The first filter 10 may be considered as a tunable multi-pair bandpass filter (TMP-BPF). In the example shown, the first filter 10 comprises a single output of all the wavelengths selected.

Figure 2B:
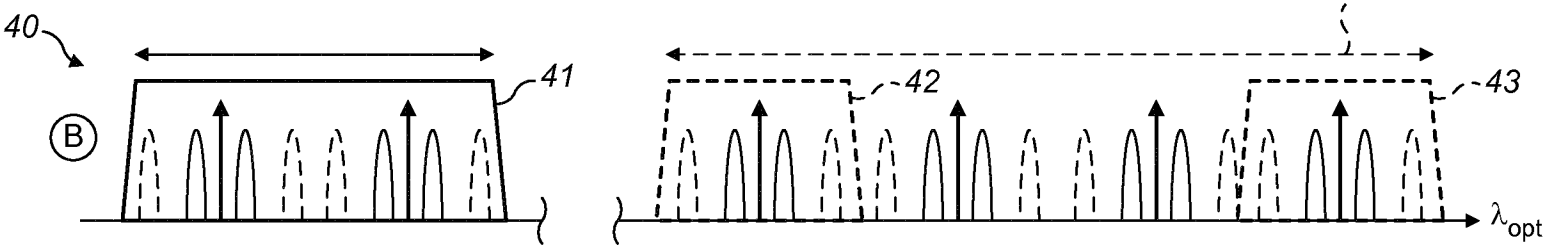

FIG. 2*b* shows an example optical spectrum 40 at point B in FIG. 1, following the first filter 10. The optical spectrum 40 has been filtered by the first filter 10, for example with one or more passbands 41,42,43,44. One or more of these example passbands comprise a plurality of wavelengths, for example, including different ones of the spectral components (e.g. modes) and the spectral components for both the original wavelength and the further associated (e.g. modulated or IF modified) wavelength. In some examples, the passband of the first filter includes in the passband 41 all of the spaced wavelengths (e.g. modes) between the lowest and highest wavelength spaced wavelength pair required. Alternatively, the first filter 10 selects only the pairs which are required. In particular, for selected non-adjacent pairs of spaced wavelengths (e.g. modes), at least one intermediate spaced wavelength (e.g. mode) is not selected by the first filter, as shown by passbands 42,43.

Referring to FIG. 1, the optical signal filtered by the first filter 10 is passed to a heterodyning device 12. The heterodyning device 12 is configured for optical heterodyne detection, in particular, for optical heterodyne detection. In some examples, the optical heterodyning device 12 is one or more photodiode. The spectral components of the optical signal are mixed by impinging together on the surface of the photodiode.

The optical heterodyning device 12 is configured to output a spectrum including the difference or beatings between pairs of optical spectral components. The difference in wavelengths brings the signal from the optical domain into the RF domain. Thus, an output of the device 12 comprises radio frequency signals. In some aspects, the radio frequency signals contain the modulation included from the modulator 4.

A second filter 14 is configured to select one or more frequency to be passed to the phased array antenna. In particular, the second filter 14 is an electrical filter. The second filter 14 filters at radio frequency. The second filter 14 is configured to select one or more RF frequency, i.e. has one or more passband. In some cases, one passband is configured to pass one frequency from the RF spectrum. In some implementations, the second filter 14 comprises a plurality of distinct passbands to select a plurality of frequencies. In some aspects, the second filter comprises a plurality of filters, each having a passband. In the example shown, the second filter 14 comprises two filters, defining two passbands.

In some examples, the one or more selected frequency is from a mix of a laser mode wavelength without modulation and a modulated (or IF modified) laser mode wavelength. The combined spectral components are associated with different spaced wavelengths or laser modes. For example, a laser mode wavelength without modulation is mixed with a modulated wavelength associated with a different laser mode. The different laser mode may be an adjacent laser mode, or a non-adjacent laser mode, i.e. separated by one or more intermediate modes.

After the detection in the PD 12, the desired beating at a multiple of the MLL repetition rate shifted by IF is selected with the RF second filter 14. By properly choosing the IF and the signal bandwidth, more than one modulating signal can be applied. If more than a pair of modes are correctly filtered, more than one RF signal can be simultaneously generated at different carrier frequencies in a single PD 12. Thus, one or more RF signal is generated for the attached element of the antenna. For each element, the RF signals may have a different frequency, time delay and/or modulation.

The first filter 10, heterodyning device 12 and second filter 14 can be considered as forming a filter unit 9. In some examples, the filter unit 9 is at the antenna site. The filter unit 9 is particular to one or more elements of the PAA.

In some aspects, the single subsystem at each antenna array element is integrated. For example, silicon photonics are used to realize the first filter 10 (TMP-BPF), e.g. based on micro-ring structures and/or III-V materials for the photodiode.

Figure 2C:
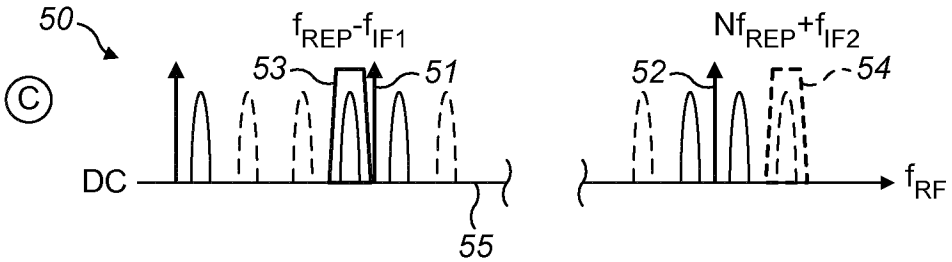

FIG. 2*c* shows an RF spectrum 50 output by the device 12, with the wavelengths selected by the second filter 14. Example frequencies in the spectrum 50 include the repetition frequency $f_{REP}$ 51, from the beating between adjacent laser modes. A further frequency $Nf_{REP}$ 52 is derived from a pair of laser modes separated by N repetition frequencies. The frequency $Nf_{REP}$ is derived from non-adjacent laser modes, i.e. separated by one or more laser modes.

In this example, a second filter 14 selects a frequency $f_{REP}-f_{IF1}$ 53 is derived from wavelengths associated with a pair of frequency adjacent laser modes. A further selected frequency $Nf_{REP}+f_{IF2}$ 54 is derived from wavelengths associated with a pair of laser modes separated by N repetition frequencies. In this case, the plurality of selected RF signals have different modulations, frequency and time delay. Further frequencies generated by the heterodyne mixing, e.g. frequency 55, are filtered out by the second filters 14. In some examples, the unmodulated RF signals are also filtered out. Alternatively, unmodulated RF signals are selected by the second filter 14, e.g. if there is no modulation or a signal without modulation is to be transmitted. Alternatively, RF signals are selected from a mixing of two modulated spectral components.

The signal generator 1 is connected to a phased array antenna 16 comprising a plurality of phased array antenna elements 18. The PAA elements 18 are arranged in an array of any format, for example, in two-dimensions (as shown) or in one or three dimensions.

The output of the filter unit 9, or second filter 14, is connected to one of the PAA elements 18. The signal generator 1 comprises one filter unit 9 per PAA element. In some examples, a plurality of filter units 9 are arranged in a matrix 20 matching the arrangement of the PAA elements 18. The signal generator 1 comprises a plurality of filter units 9. Each filter unit 9 receives the same optical signal from the dispersion unit 8 (e.g. DCF).

In some aspects, to form a beam, the first filter 10 for a plurality of PAA element 18 is configured to select different wavelengths. This provides for different RF signals (e.g. different time delays) for a plurality of the PAA elements 18. The frequency of the RF signals is the same within the beam, although the optical signals from which the RF signals derive may differ. Since the dispersion unit 8 introduces a delay based on the wavelength of the optical signal, selection of the optical wavelengths to form the RF signals allows a selection of the delay, for a particular frequency of RF signal. The dispersion unit 8 is arranged to introduce a true time delay to optical components which do not yet comprise a RF component. Thus, the true time delay is introduced onto an optical signal which does not contain an RF signal.

In some aspects, the signal generator 1 is configured to provide different RF signals for at least some of the PAA elements 18. The RF signal at each element 18 is independent. In some examples, the signal generator 1 is configured to provide different RF signals for all of the PAA elements 18, or the RF signals are the same for a plurality of PAA elements 18, depending on the beam which is to be formed. The PAA elements 18 are configured as multi-band (or several single-band) PAA elements.

The signal generator 1 is configured to generate RF signals for the PAA with the required delay for true time delay beamforming. The signal generator 1 both optically generates the RF signals and optically introduces the time delay. The IF signal is also introduced to an optical signal. The RF signal for the phased array antenna is first generated by the heterodyne device.

Each element 18 of the antenna is fed by a pair of modes from the mode locked laser for each of the RF signals to be transmitted. The stability of the mode locked laser guarantees the high quality of the generated RF signals. The mode-locked laser is used to optically generate highly stable RF carriers by heterodyning its phase-locked modes in a photodiode. To generate modulated signals instead of simple continuous waves, the MLL spectrum is optionally modulated by the signal at intermediate frequency (IF). The delay of each RF signal at each antenna element is defined by the wavelength of the mode pair, through the chromatic dispersion of the feeding fiber. The large number of modes available from the mode locked laser allows generation of multiple independent RF signals in large phased array antennas.

Since the RF signal frequency is determined by the relative frequency detuning of the selected modes, the same signal can be generated by selecting laser modes in different positions of the optical spectrum. If the optical spectrum undergoes chromatic dispersion, the spectral components experience different delays depending on their wavelength. Thus, the same RF carrier can reach the antenna with different delays according to the wavelength of the selected mode pair. The delay Δt induced by changing the filter position is given by:

$$\Delta t = D \cdot \Delta\lambda \qquad \text{(equation 1)}$$

where D is the value of the chromatic dispersion and Δλ the wavelength difference of the selected mode pairs. The delay induced on the RF signal is independent of its carrier frequency and bandwidth.

Each pair of modes is delayed differently by introducing chromatic dispersion. The delay of the signals at each antenna element is controlled by choosing the appropriate mode pair. The mode pair is selected according to its wavelength to achieve the required delay for an antenna element, even though the mode pair does not contain an RF modulation. The mode pairs include both the time delay and particular wavelengths to be heterodyned to an RF signal. The wavelengths of the mode pairs determine the time delay, and the separation of the mode pairs determine the frequency of the RF signal transmitted by the antenna element. References to mode pairs here includes spectral components associated with mode pairs, i.e. components generated by modulating a mode of the mode pair. The heterodyned components are, or are associated with, different modes. As such, the heterodyned components passed to the antenna element may be considered as a mode pair.

The modulation of the RF signal is introduced on the optical signal. The mixing of the optical signals provides an RF signal containing the modulation. In some examples, the modulated RF signal is selected, e.g. by a filter, to be provided to the elements of the PAA. The modulation is introduced prior to the time delay (e.g. by dispersion). The modulation is also introduced to the optical signal as a separate step to the generation of the RF signal. The modulation is introduced prior to the RF signal.

In some aspects, the use of modulation at an IF allows a plurality of modulations to be used with the same PAA. A different frequency of IF is used for each modulation signal. The different frequencies of IF may be selected as described, e.g. with the second filter 14. In some examples, the different frequencies of IF may be selected for the PAA independently of the frequency of the RF signal on which the modulation is carried. This allows a plurality of modulation signals for the PAA at the required RF frequencies.

In some aspects, the IF signal has a tunable or variable frequency. The tunable frequency of the IF signal allows the RF signal generated to be varied. Thus, the RF signals which can be generated are not limited to the difference between two fixed frequencies (i.e. fixed mode frequency and/or fixed IF frequency). In some examples, the IF signal is variable over a range which is equal to or greater than the spacing between the wavelengths from the laser light source, e.g. mode spacing. This allows the RF signal to be generated at any frequency, e.g. with the appropriate combination of IF frequency spacing and number of mode spacings. The IF signal may or may not be modulated.

In some aspects, the IF signal allows a straightforward generation of RF signals with phase modulations. In some aspects, the IF signal generates a separate spectral component from the laser mode spectral component. The signal generator is configured to select the RF signal based on the IF signal (e.g. modulated signal), without selection of the original (e.g. unmodulated) laser mode spectral component. Alternatively, the signal generator is configured to select the spectral component of the IF signal (e.g. modulated signal), without selection of the original (e.g. unmodulated) laser mode spectral component.

In example of the present invention, the laser source 2 is a fiber MLL. For example, the MLL has a repetition rate of 9953 MHz, having modes with a full width half maximum (FWHM) of about 0.7 nm. In one example, the MLL modes extend at least between 194.165 THz and 194.265 THz. The dispersion compensating fiber 8 has a total accumulated chromatic dispersion of −160 ps/nm. The filtering matrix comprises a waveshaper as the first filter, for example, a programmable filter waveshaper. The first filter is configured to operate as a single 50 GHz-bandwidth bandpass filter. In this case, the first filter is configured to select five adjacent lines of the MLL. The optical signal is detected by a 40 GHz-bandwidth photodiode. The PD generates an RF signal made of components at approximately 10, 20, 30, and 40 GHz. The PD output is split into two paths, and two electrical bandpass filters centered at 9953 MHz and 39812 MHz isolate the spectral components. In some examples, the first filter may vary in 10 GHz steps between PAA elements in order to select different groups of modes.

In some examples, the IF signal has a frequency which is less than the repetition frequency between spaced wavelengths. In some examples, the IF signal carrying modulation has a frequency which provides for separation of the IF spectral component from a laser mode frequency. In some examples, the IF signal carries a modulating signal of bandwidth B. For a double sideband modulation, the IF is in the range between (B/2) and ($F_{REP}$/2−B/2). For a single sideband modulation, the IF is in the range between (B/2) and ($F_{REP}$−B/2).

Figure 3:
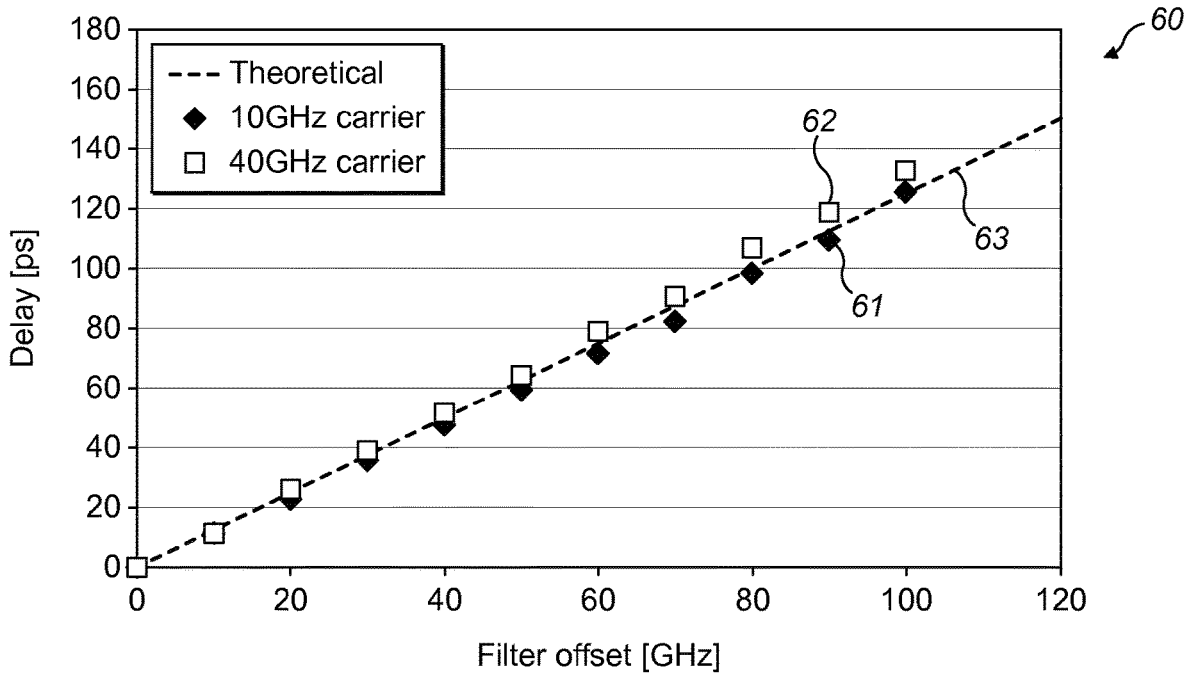
FIG. 3 is an example of the time delay introduced by the signal generator.

FIG. 3 shows an example graph 60 of the time delay introduced for exemplary RF components at 9953 MHz (points 61) and 39812 MHz (points 62), as measured. The time delay is a function of the bandpass of the optical first filter 10. The graph 60 shows the time delay related to the first filter offset, i.e. the frequency difference from an initial position. The graph 60 also shows a theoretical delay curve (line 63) given by equation (1).

The delay functions for lines 61,62 at 9953 MHz and 39812 MHz present an identical linear trend, and fit the theoretical line very well. Thus, the arrangement describes provides for effective TTD of a signal spanning over 30 GHz. Since the MLL presents a discrete spectrum, the available delays are discrete as well. A delay step between available delays is determined by the MLL line spacing (i.e. the MLL repetition rate) and the amount of chromatic dispersion. In this example, according to equation 1, the time delay step is 12.6 ps.

Figure 4:
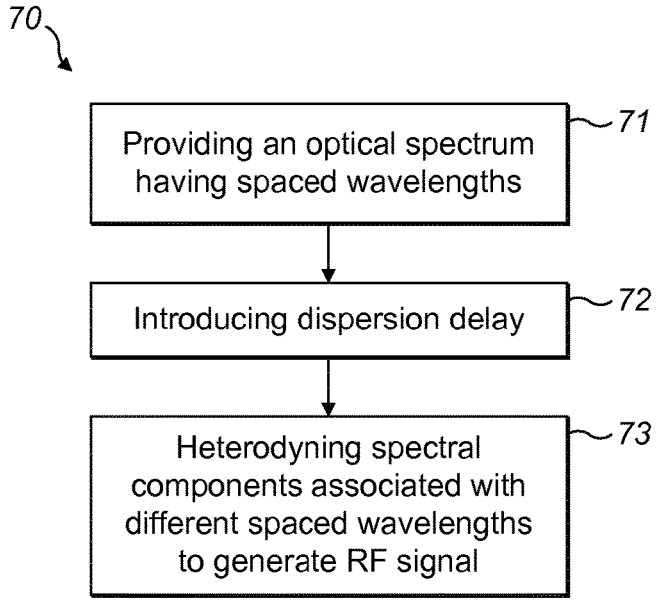
FIG. 4 is a method according to an example of the present invention.

FIG. 4 shows an example method 70 according to an aspect of the invention. The method 70 is a method of generating a signal for a phased array antenna. In 71, the method comprises providing an optical spectrum comprising a plurality of spaced wavelengths. The spaced wavelengths are mode wavelengths of a mode-locked laser, as described above.

In 72, the method further comprises introducing a delay to spectral components of the optical spectrum. The time delay introduced is based on wavelengths of the laser light source, wherein the delay is dependent on the wavelength of the spectral components of the optical spectrum. In particular, the delay is introduced by dispersion. For example, the dispersion is introduced in a fiber, e.g. a DCF.

In 73, the method comprises heterodyning the spectral components associated with different ones of the spaced wavelengths of the laser light source to generate a signal for the phased array. In particular, spectral components associated with different modes of the MLL are heterodyned together. The spectral components associated with a mode comprise the original mode wavelength and a wavelength resulting from modulation of that original mode wavelength. The difference between the spaced wavelengths, e.g. the spacing of the mode wavelengths is a radio frequency. Thus, the heterodyning generates an RF signal for the first time. The RF signal includes a time delay selected according to the wavelengths used to generate the RF signal. The frequency of the RF signal is also dependent on the wavelengths used to generate the RF signal.

In some examples, the generated RF signal is output to elements of the phased array antenna. The RF signal is transmitted from the PAA.

Figure 5:
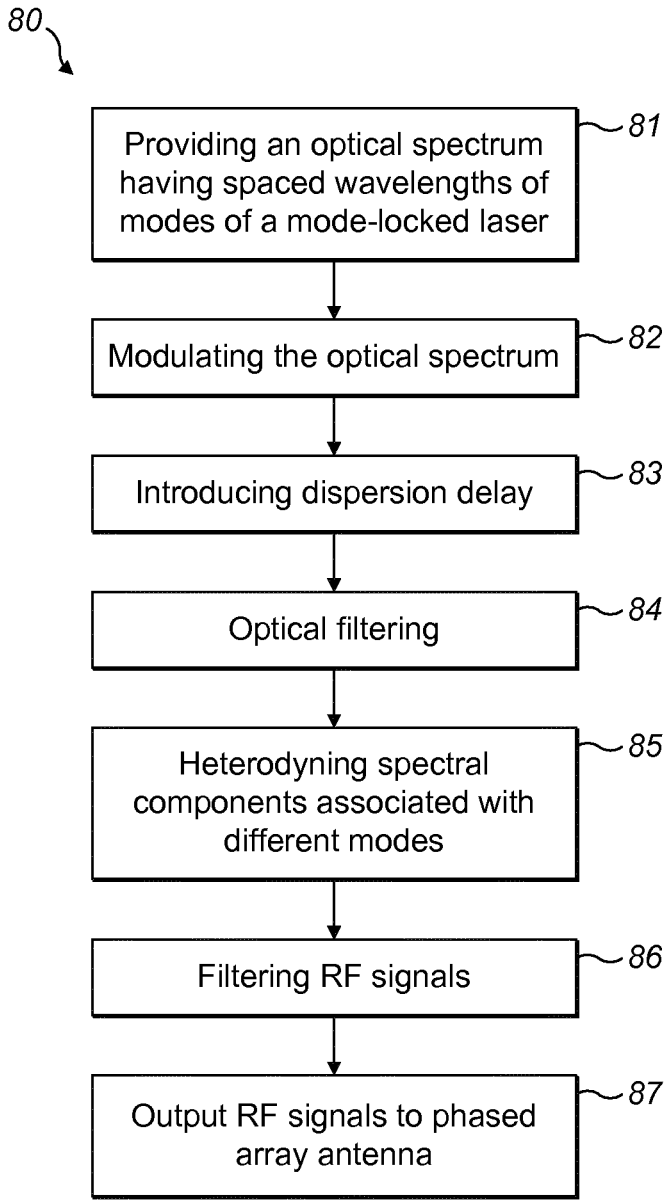
FIG. 5 is a method according to a further example of the present invention.

FIG. 5 shows a further example method 80 according to an aspect of the invention. The method 70 is a method of generating a signal for a phased array antenna. In 81, the method comprises providing an optical spectrum comprising a plurality of spaced wavelengths. The spaced wavelengths are mode wavelengths of a mode-locked laser, as described above.

In 82, the method comprises modulating the plurality of spaced wavelengths of the laser source with one or more modulating signals.

In 83, the method further comprises introducing a delay to spectral components of the optical spectrum. The time delay introduced is based on wavelengths of the laser light source, wherein the delay is dependent on the wavelength of the spectral components of the optical spectrum. In particular, the delay is introduced by dispersion. For example, the dispersion is introduced in a fiber, e.g. a DCF.

In 84, the method further comprises filtering the optical spectrum to select a part only of the optical spectrum. In some examples, the optical filter selects at least one pair of spectral components. For example, the optical filter selects a first pair of spaced wavelengths for generating a first frequency signal for the phase array antenna and a second pair of spaced wavelengths for generating a second frequency signal for the phase array antenna. The optical filtering, i.e. with the first filter 10 described above, selects at least the spectral components to provide the required time delay and frequency of RF signal after heterodyning. In some aspects, the first filter 10 selects other spectral components which are not used and subsequently filtered out.

In 85, the method comprises heterodyning the spectral components associated with different ones of the spaced wavelengths of the laser light source to generate a signal for the phased array. In particular, spectral components associated with different modes of the MLL are heterodyned together. The spectral components associated with a mode comprises the original mode wavelength and a wavelength resulting from modulation of that original mode wavelength. The difference between the spaced wavelengths, e.g. the spacing of the mode wavelengths is a radio frequency. Thus, the heterodyning generates an RF signal for the first time. The RF signal includes a time delay selected according to the wavelengths used to generate the RF signal. The frequency of the RF signal is also dependent on the wavelengths used to generate the RF signal.

In 86, the method further comprises filtering radio frequencies received from the heterodyning device to select one or more RF signals for the phased array antenna.

In 87, the generated RF signal is output to elements of the phased array antenna. One or more RF signals is output to each element, each RF signal having a time delay and frequency independent of other RF signals for that element. The time delay of each RF signal for an element is independently generated of the time delay for other of the plurality of elements. The RF signals are transmitted from the PAA in a beam.

The delay introduced for each RF frequency is independent of one or more other RF frequency. In particular, the relative delay or advance of the RF signals is independent of the frequency. For example, a first frequency RF beam (e.g. 10 GHz) is steered in the opposite (or same) direction as a second frequency RF beam (e.g. 40 GHz). Aspects of the invention provide for simultaneous independent beamsteering of the RF signals in a phased array antenna. The generation of multiple independent wideband RF signals is with high phase stability, free from the squint phenomenon, with high angular resolution and broad angular range.

Aspects of the present invention include into the same photonics-based functional block both the beamforming through TTD and the generation of the RF signal. This combines the effectiveness of the optical beamforming with the high performance of the photonics-based RF generation, advantageously using the photonics subsystem in the RF transmitter. In particular, examples integrate the functions of TTD beamforming and RF signal generation. Aspects of the invention generate multiple and wideband RF signals, e.g. over a wide range up to 100 GHz. The delay is controllable arbitrarily and independently.

The arrangement is robust to the squint effect that renders the RF signal dependent on the frequency. The arrangement allows obtaining high phase stability of the generated RF signals independently of the carrier frequency. Aspects of the invention are suitable for wideband and multi-carrier applications. A relatively large delay, and tunable delay, with high resolution can be applied to the signals. The multiple functionalities allow a reduction in the cost of the photonic system by utilizing the flexibility, wide bandwidth, and high stability of the system. The signal generator 1 presents electromagnetic interference (EMI) immunity, low losses, and potential for low weight and power consumption. The signal generator 1 directly generates the RF signal with the TTD already included. A separate generation of RF signal, which requires conversion to an optical signal, is not required. The signal generator is configured to only generate the RF signal from a mix of spectral components associated with different ones of the spaced wavelengths (e.g. modes). In particular, the RF signal is not generated from a mix of two spectral components associated with the same one of the spaced wavelength, e.g. the RF signal is not generated from a mix of two spectral components associated with the same mode. For example, the RF signal is not generated by modulating a laser frequency with an RF signal, and mixing the modulated signal with the same laser frequency.

The extended use of photonics reduces the number of electro/optical and opto/electrical conversions. It is not necessary to generate an RF signal with which to modulate the laser source. For example, prior at photonics-based solutions require a functional block that converts the signal from the RF domain to the optical domain in order to implement the TTD functionality, and then converts back to the RF domain. The conversion of the signal results in an increased cost and complexity for the system. In aspects of the present invention, the use of an optical fiber provides a simple means for feeding of the antenna array. The optical fiber provides the further function of including the time delay.

Aspects of the invention may be used for RF transceivers with directional phased array antennas as multi-function multi-signal radars, radio links, communications, hybrid system for communications and surveillance. Aspects of the invention are used for beamforming of transmission signals.

In some examples, the signal generator comprises a processor configured to control the beamforming. In particular, the processor controls the modulation and/or one or more of the filters. For example, the processor controls the first filter 10 and/or second filter 14 to select the time delay and/or the RF frequency provided to the PAA elements 18. In some examples, the processor is arranged to access a memory of stored filter parameters to provide pre-determined beam angles and/or signal frequencies.

Aspects of the invention also comprise a phased array, comprising an antenna and signal generator as described above. The antenna comprises a plurality of elements, for which RF signals having a determined true time delay and frequency are provided by the signal generator, as described in any example of the invention.

The first filter 10 is been described as having a single output to the photodiode. Alternatively, the first filter 10 has a plurality of outputs. The first filter 10 is configured to output a different passband or selected modes to different outputs. Each output is connected to an optical heterodyning device, e.g. photodiode. In some examples, only the desired mode pairs are output (i.e. without intermediate modes if the desired modes are non-adjacent). In some examples, a plurality of outputs each provide one mode pair (including associated modulation wavelengths) only. In this case the second filter after the photodiode is not necessary. For example, the first filter 10 is configured (programmed) to route to one output port a pair of modes having a first spacing (e.g. 10 GHz-spaced modes) and to another output port a pair of modes having a second spacing (e.g. 40 GHz-spaced modes). Alternatively, a plurality of output ports are arranged to each output a pair of modes with a first spacing and a pair of modes with a second spacing.

Due to the baseband modulation, there are no IF spectral components. The BPFs after the photodiodes are not necessary, and so may not be included in the signal generator. In some aspects, the modulator is configured such that the optical spectrum after the modulator comprises only modulated modes. In some examples, the optical spectrum does not comprise separate modulation sidebands. The applied modulation may be on-off modulation. The applied modulation is at baseband. The beating between any of the modulated modes results in a RF signal with up-converted on-off modulation. In this case, only the first filter is required to select the signals for the PAA (e.g. second may not be present).

The spectral components may be any combination of modulated sidebands (e.g. from modulation with an IF signal) or spectral components with a wavelength generated directly by the laser light source. The spectral component may or may not be shifted by an Intermediate Frequency, optionally carrying a modulation. For example, one or both the spectral components which are heterodyned for use in the phased array antenna may be an unmodulated wavelength as generated by the laser light source, e.g. a wavelength of a laser mode. Alternatively or in addition, one or both the spectral components may be a modulated signal.

The modulated wavelength may have a frequency which is different to or substantially the same as the frequency of the wavelength provided by the laser light source, e.g. the mode wavelengths. For example, the modulation may or may not generate a separate modulation sideband. In some aspects, the modulation may be included in an IF signal (frequency of spectral component different to the associated unmodulated mode) or included in a baseband signal (frequency of spectral component not substantially different or separate from the associated unmodulated mode). Both IF and baseband signals may be referred to as sidebands, e.g. modulation sidebands.

In some aspects, at least one of the two spectral components which are mixed is modulated. In particular, the RF signal is from a mix of two laser mode wavelengths with at least one of the laser mode wavelengths modulated. Alternatively, both of the spectral components which are mixed and selected are modulated. Alternatively, neither of the spectral components which are mixed and selected are modulated.

The laser source has been described as a mode-locked laser. Alternatively, any one or more suitable sources of laser light arranged to provide wavelengths of a pre-determined separation may be used.

In some examples, the signal generator 1 comprises the laser generating the laser light. In other aspects, the signal generator receives the laser light, but does not comprise the laser itself. The term laser source refers to any source of laser light, whether that is the laser itself or an input of laser light from a functionally external laser.

In some examples of the invention, the modulator 4 is not present. The laser source 2 is connected directly to the fiber 8. This provides for generation of simple continuous waves, instead of modulated signals.

The phased array antenna may alternatively be referred to as a phased array. The phased array may be considered as comprising a plurality of antennas (i.e. described above using the term 'element').

The invention claimed is:

1. A signal generator for a phased array antenna having a plurality of antenna elements, wherein the signal generator generates a respective radio frequency (RF) signal for each respective one of the antenna elements, wherein each respective RF signal has a respective frequency and a respective delay, the signal generator comprising:

a single laser light source arranged to provide an optical spectrum comprising a plurality of spaced wavelengths, wherein the plurality of spaced wavelengths is at least three spaced wavelengths, and wherein the at least three spaced wavelengths are spaced apart from one another by differences in wavelengths corresponding to radio frequencies;

a dispersion unit arranged to introduce a delay to a plurality of spectral components of the optical spectrum associated with the spaced wavelengths, wherein the delay is dependent on the wavelength of the spectral components of the optical spectrum;

a respective optical filter for each respective one of the antenna elements, wherein each respective optical filter is configured to respond to received directions by selecting and supplying a respective indicated pair of spaced wavelengths from the plurality of delayed spectral components of the optical spectrum, wherein for each respective one of the antenna elements, wavelengths of the supplied pair of spaced wavelengths are spaced apart from one another by differences in wavelength corresponding to a required radio frequency and each supplied pair of spaced wavelengths has a required delay for the antenna element; and a respective heterodyning device for each respective one of the antenna elements, wherein each respective heterodyning device is configured to generate the RF signal for radiation by the respective one of the antenna elements of the phased array antenna by heterodyning the selected pair of spaced wavelengths supplied by the respective optical filter.

2. The signal generator as claimed in claim 1 wherein the laser light source comprises a mode-locked laser configured to provide the optical spectrum having the plurality of spaced wavelengths, wherein the spaced wavelengths correspond to laser modes; and the heterodyning device is configured to heterodyne spectral components associated with different modes.

3. The signal generator as claimed in claim 1 wherein a said spectral component associated with the spaced wavelength is a modulated sideband of the spaced wavelength and/or a said spectral component associated with the spaced wavelength is a wavelength generated by the laser light source, and is a mode wavelength of a mode-locked laser.

4. The signal generator as claimed in claim 1, wherein the optical filter is configured to select one or both of: a first pair of spaced wavelengths for generating a first frequency signal for the phase array antenna, and a second pair of spaced wavelengths for generating a second frequency signal for the phase array antenna.

5. The signal generator as claimed in claim 1, wherein the signal generator comprises one or more radio frequency (RF) filter arranged to receive an RF signal from the heterodyning device and select one or more RF signals for the phased array antenna.

6. The signal generator as claimed in claim 1, wherein one or both of:

the optical filter comprises a tunable bandpass filter configured to select only a part of the optical spectrum; and the signal generator further comprises one or more tunable bandpass filters arranged to receive an RF signal from the heterodyning device and select one or more RF signals for the phased array antenna.

7. The signal generator as claimed in claim 1, wherein the signal generator comprises a modulator configured to modulate at least one of the plurality of spaced wavelengths received from the laser source with one or more modulating signals.

8. The signal generator as claimed in claim 1, wherein the laser light source comprises a modulator configured to modulate at least one spaced wavelength with one or more intermediate frequency (IF) signal.

9. The signal generator as claimed in claim 1, wherein:

the optical filter is one of a plurality of optical filters; and wherein the signal generator comprises a filtering matrix comprising a plurality of filter units, wherein each filter unit is configured to be coupled to at least one element of the phased array antenna, and each filter unit comprises a respective one of the optical filters for selecting one or more pairs of spectral components associated with the spaced wavelengths for the heterodyning device, each filter unit further comprising the heterodyning device, and configured to output an RF signal to an element of the phased array antenna.

10. The signal generator as claimed in claim 9 wherein each filter unit is configured to select spectral components to provide a same frequency RF signal to each element, wherein each filter unit is configured to select the spectral components such that a delay on each RF signal provides for beamforming.

11. A method of generating a radio frequency (RF) signal for radiation by a phased array antenna having a plurality of antenna elements, wherein the method generates a respective radio frequency (RF) signal for each respective one of the antenna elements, wherein each respective RF signal has a respective frequency and a respective delay, the method comprising:

using a single laser light source to provide an optical spectrum comprising a plurality of spaced wavelengths, wherein the plurality of spaced wavelengths is at least three spaced wavelengths, and wherein the at least three spaced wavelengths are spaced apart from one another by differences in wavelengths corresponding to radio frequencies;

introducing a delay to a plurality of spectral components of the optical spectrum associated with the spaced wavelengths, wherein the delay is dependent on the wavelength of the spectral components of the optical spectrum;

for each respective one of the antenna elements, responding to received directions by filtering the delayed spectral components of the optical spectrum to select and supply a respective indicated pair of spaced wavelengths from the plurality of delayed spectral components of the optical spectrum, wherein for each respective one of the antenna elements, wavelengths of the supplied pair of spaced wavelengths are spaced apart from one another by differences in wavelength corresponding to a required radio frequency and each supplied pair of spaced wavelengths has a required delay for the antenna element;

for each respective one of the antenna elements, generating the RF signal for radiation by the respective one of the antenna elements of the phased array antenna by heterodyning the selected pair of spaced wavelengths supplied by the respective filtering.

12. The method as claimed in claim 11 wherein the laser light source provides the optical spectrum from a mode-locked laser providing the plurality of spaced wavelengths corresponding to the laser modes; and heterodyning spectral components associated with different modes.

13. The method as claimed in claim 11, wherein the optical filtering selects one or both of a first pair of spaced wavelengths each having at least one associated spectral component for generating a first frequency signal for the phase array antenna, and a second pair of spaced wavelengths each having at least one associated spectral component for generating a second frequency signal for the phase array antenna.

14. The method as claimed in claim 11, comprising filtering radio frequencies received from the heterodyning device to select one or more RF signals for radiation by the phased array antenna.

15. The method as claimed in claim 11, comprising one or both of:

modulating at least one spaced wavelength received from the laser source with one or more modulating signals, and modulating at least one spaced wavelength received from the laser source with an Intermediate Frequency signal.

16. A phased array comprising a plurality of phased array antenna elements, wherein the phased array generates a respective radio frequency (RF) signal for each respective one of the antenna elements, wherein each respective RF signal has a respective frequency and a respective delay, the phased array further comprising:

a single laser light source arranged to provide an optical spectrum comprising a plurality of spaced wavelengths, wherein the plurality of spaced wavelengths is at least three spaced wavelengths, and wherein the at least three spaced wavelengths are spaced apart from one another by differences in wavelengths corresponding to radio frequencies;

a dispersion unit arranged to introduce a delay to spectral components of the optical spectrum, wherein the delay is dependent on the wavelength of the spectral components of the optical spectrum;

a respective optical filter for each respective one of the antenna elements, wherein each respective optical filter is configured to respond to received directions by selecting and supplying a respective indicated pair of spaced wavelengths from the plurality of delayed spectral components of the optical spectrum, wherein for each respective one of the antenna elements, wavelengths of the supplied pair of spaced wavelengths are spaced apart from one another by differences in wavelength corresponding to a required radio frequency and each supplied pair of spaced wavelengths has a required delay for the antenna element; and a respective heterodyning device for each respective one of the antenna elements, wherein each respective heterodyning device is configured to generate the RF signal for radiation by said respective one of the antenna elements of the phased array antenna by heterodyning the selected pair of spaced wavelengths supplied by the respective optical filter.

17. A non-transitory computer-readable storage medium comprising a computer program product, configured when run on a computer to carry out a method of generating a radio frequency (RF) signal for radiation by a phased array antenna having a plurality of antenna elements, wherein the method generates a respective radio frequency (RF) signal for each respective one of the antenna elements, wherein each respective RF signal has a respective frequency and a respective delay, the method comprising:

using a single laser light source to provide an optical spectrum comprising a plurality of spaced wavelengths, wherein the plurality of spaced wavelengths is at least three spaced wavelengths, and wherein the at least three spaced wavelengths are spaced apart from one another by differences in wavelengths corresponding to radio frequencies;

introducing a delay to a plurality of spectral components of the optical spectrum associated with the spaced wavelengths, wherein the delay is dependent on the wavelength of the spectral components of the optical spectrum;

for each respective one of the antenna elements, responding to received directions by filtering the delayed spectral components of the optical spectrum to select and supply a respective indicated pair of spaced wavelengths of spaced wavelengths from the plurality of delayed spectral components of the optical spectrum, wherein for each respective one of the antenna elements, wavelengths of the supplied pair of spaced wavelengths are spaced apart from one another by differences in wavelength corresponding to a required radio frequency and each supplied pair of spaced wavelengths has a required delay for the antenna element;

for each respective one of the antenna elements, generating the RF signal for radiation by the respective one of the antenna elements of the phased array antenna by heterodyning the selected pair of spaced wavelengths supplied by the respective filtering.

* * * * *